US005636576A

United States Patent [19]

Gimenez et al.

[11] Patent Number: 5,636,576

[45] Date of Patent: Jun. 10, 1997

[54] TILTING SYSTEM FOR RAILWAY ROLLING STOCK

[75] Inventors: Jose G. Gimenez; Juan F. Garcia, both of Beasain, Spain

[73] Assignee: Construcciones y Auxiliar de Ferrocarriles, S.A., Spain

[21] Appl. No.: 556,274

[22] Filed: Nov. 13, 1995

[51] Int. Cl.[6] ..... B61F 5/00

[52] U.S. Cl. ..... 105/199.2

[58] Field of Search ..... 105/199.2, 199.1, 105/219, 168

[56] References Cited

U.S. PATENT DOCUMENTS

| | | | |
|---|---|---|---|
| 2,988,015 | 6/1961 | Lich | 105/199.2 |
| 3,701,397 | 10/1972 | Shirane et al. | 105/199.2 |
| 3,717,104 | 2/1973 | Law et al. | 105/199.2 X |
| 3,902,691 | 9/1975 | Ott | 105/171 X |
| 4,715,289 | 12/1987 | Okamoto et al. | 105/199.2 |
| 4,982,671 | 1/1991 | Chollet et al. | 105/168 |
| 5,255,611 | 10/1993 | Schneider | 105/199.2 |
| 5,295,443 | 3/1994 | Bangtsson et al. | 105/199.2 |

FOREIGN PATENT DOCUMENTS

| | | | |
|---|---|---|---|
| 4090962 | 3/1992 | Japan | 105/199.2 |
| 4066366 | 3/1992 | Japan | 105/199.2 |

*Primary Examiner*—Mark T. Le

*Attorney, Agent, or Firm*—Bierman, Muserlian and Lucas

[57] ABSTRACT

Tilting system for railway vehicle, having a memory unit with the parameters of the sections of the route, a position detector system which continually communicates the parameters of speed and actual absolute position of the vehicle to an intelligent control unit in which a set of standard commands has been established, quantified using the values of the parameters which are received from the memory unit and the position detector system, establishing a set of standard instructions which are sent to tilting actuators placed between the bogie chassis and the frame of the vehicle.

8 Claims, 2 Drawing Sheets

TILTING SYSTEM FOR RAILWAY ROLLING STOCK

Tilting trains offer a solution to the problem of comfort when running in a curve at high speeds. However, the increase in speed in the curve also gives rise to an increase in the stresses on the carriage wheel which in the majority of circumstances prevents the exploitation of all the possibilities of increasing speed provided by the tilting system.

Tilting trains which have been designed to date operate by the detection and identification of characteristics of the curves encountered in real time. They utilise the parameters related to the dynamic response of the vehicle, forexample speed and acceleration, which the sensors fixed in the train pick up. When among the signals produced through track variations measured by the on-board sensors (normal cornering speed meters and accelerometers) an approach to a curve is identified, this operates the tilting devices giving rise to the inclination of the vehicle in relation to the bogie by means of some prefixed control strategies.

This form of operation gives rise to a number of disadvantages which we list below:

By definition, there is delay in identification of the curve. A specified lapse of time has to pass before the system detects that there is a curve.

The standard of inclination of the vehicle produced by the tilting systems at present in service is not the best one from the point of view of passenger comfort.

Anticipated operation of the system, if it exists, is independent of the type of curve which is approaching.

In order to avoid these problems, the system which is the subject of the invention makes use of previous knowledge of the journey and utilises equipment (called SDP) which detects the position of the train continuously with accuracy of a few meters. The system consists of an intelligent control unit programmed with a standard set of command parameters obtained by means of the application of a conventional programme of dynamic simulation of behaviour of the vehicle in a curve having a calculation of inverse dynamics, these establishing that the dynamic parameter is the lateral acceleration of the passenger in the vehicle in accordance with a pre-fixed profile.

In what follows we describe an example of a practical implementation, which is not limitative, of the present invention. We do not discount absolutely other forms of implementation in which minor changes can be introduced which do not detract from the fundamental idea; on the contrary, this invention embraces all its variants.

Figure 1:
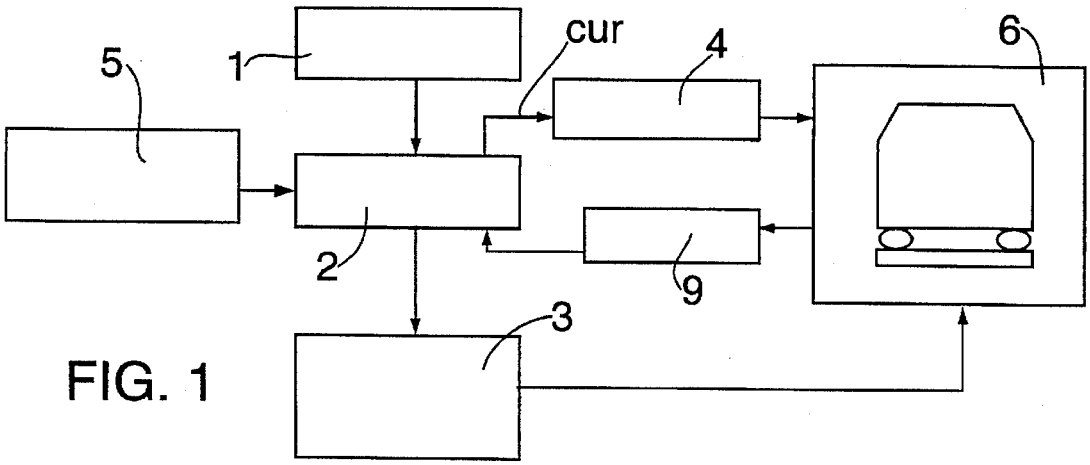
FIG. 1 is a block diagram of the system which is the subject of the invention.

This system of tilting consists of the following units (FIG. 1):

The position detector system (1) (called SDP) which is responsible for determining at any moment the speed and absolute position of the vehicle on the track.

The tilting control unit (2) (UCB), which generates the instructions for tilting and controls their execution in real time.

Axle orientation system (3) which causes the lateral carriage wheel stresses in the two axles of one and the same bogie to be equalised and, in addition, reduces its maximum value in a curve. In this way the velocity of the vehicle in the curve is increased.

The tilting actuators (4) are responsible for executing in a mechanical manner the tilting instructions generated by the (UCB).

Vehicle (6).

A memory unit (5) of the journey which is divided into sections identified by their parameters such as absolute position, radius of curvature, length of each section of curve, etc.

Figure 5:
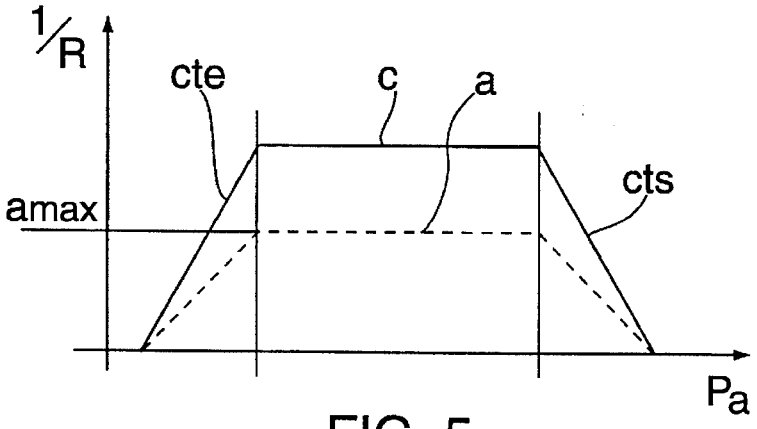
FIG. 5 is a representation with coordinates of a profile of accelerations (a) to be used for the system.

Each curve has an entry transition curve (cte), the curve (c) as such and an exit transition curve (cts) (FIG. 5).

In this unit (5) there are identified the sections of curve in which the operation of the tilting system is to commence.

The operating method of the tilting system is as follows. The (SDP) (1) informs the (UCB) (2) of the absolute real position and travelling velocity of the vehicle. The (UCB) (2) receives this information and consults its journey memory (5) in order to find out the route parameters at this point. If this position coincides with a section of curve in which the tilting system has to operate, an instruction signal (cur) is generated for the tilting actuators (4) and for the axle orientation system (3) in accordance with a standard set of parameters related to the travelling velocity and the characteristics of the route.

This standard set of parameters is a standardised curve (cur) with abscissas and ordinates of the following form:

cur=func.param(vel, Lt, R, per, pos)

where:

cur=instruction standard func.param=function of the parameters vel=travelling velocity of vehicle Lt=length of the transition curve R=radius of curvature of the route per=difference in curvature between inner and outer rail pos=absolute position for which cur is evaluated.

The set of parameters is drawn up using, for example, polynomial or harmonic functions.

The set of parameters (func.param) is unique for all curves and for each type of vehicle. In order to obtain the standard instruction (cur) in each case it is sufficient to input the values of vel, Lt, R, per and pos in the previous formula.

This standard set of parameters or standard behaviour of the vehicle in the curve is defined for the user as the most suitable for the type of route to be taken by the vehicle and it is dependent upon the dynamic characteristics of the vehicle, the type of actuator used, as well as its physical location. This can be obtained in conventional manner by means of theoretical or practical methods of analysis.

An example of how to obtain this standard set of parameters for a concrete case is as follows. Given the type of route to be covered, the dynamic characteristics of the vehicle, the type of actuator and its location in the vehicle, a dynamic simulation is produced by computer of the behaviour of the vehicle in a curve.

These (conventional) simulation programmes have, among other facilities, an inverse dynamic calculation package. With this facility it is possible to find out what standard has to be followed by a command signal (standard command) of an actuator in order for a dynamic parameter of the vehicle to follow a pre-established standard. This is to say, knowing beforehand what is the answer to the problem (the pre-established standard for a dynamic parameter of the vehicle) one has to find out what is the question (the standard for the actuator). The standard obtained is adjusted and given parameters by means of a conventional method, this being by use of polynomial or harmonic functions.

For this system of tilting the pre-established standard which has been fixed as the objective is a trapezoidal outline for the lateral acceleration (a) experienced by the passenger (FIG. 5). The shape of this curve is proportional to the profile of the curvature of the route (I/R) and the amplitude of maximum lateral acceleration (amax) of the passenger, which is for example, limited to 0.55 $m/s^2$.

cte=entry transition curve c=curve proper cts=exit transition curve

Pa=absolute position

The actuators (4) are what initiate the tilting. They are positioned between the chassis of the bogie (8) and, directly or indirectly, the frame (7) of the vehicle (6). They can be of various types, such as: hydraulic, electromechanical, etc. In order to produce in the frame (7) the desired effect of tilting, they may have certain mechanical elements between the bogie and the frame which ensure relative movement between both. They also incorporate some turning meters (9) which supply the (UCB) (2).

We describe hereafter two examples of practical implementation, which are not limitative, showing the mechanical configuration of a tilting vehicle: articulated configuration and configuration with differentiated suspension.

Figure 2:
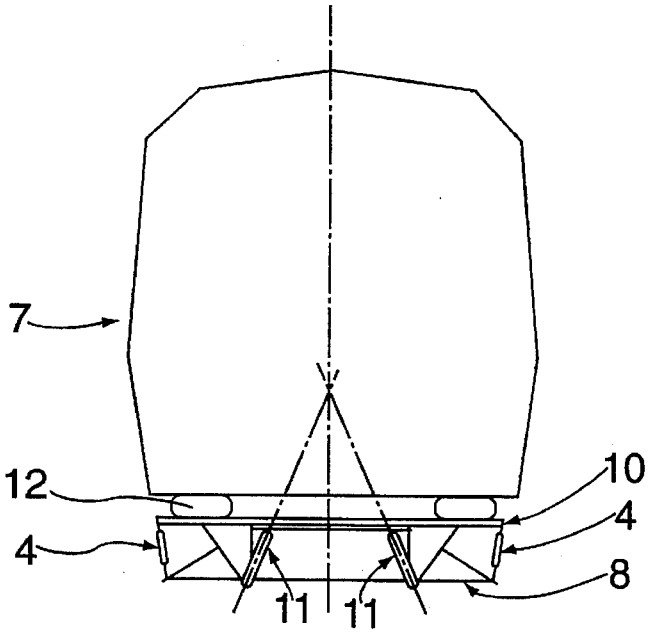
FIG. 2 is a diagrammatic view of a practical implementation of the invention in which the chassis of the bogie and the frame of a railway vehicle are indicated by a quadrilateral outline.

Configuration 1: Articulated (FIG. 2)

This configuration is based upon the incorporation between the bogie chassis (8) and the frame (7) of a rail vehicle of a tilting cross-beam (10) shown by means of a quadrilateral outline, for example by means of the shafts (11). This tilting cross-beam (10) supports the base of the secondary vertical suspension (12) which can be of conventional type, with springs or pneumatic cylinders. The only relative movement permitted between the bogie chassis and the tilting cross-beam is one of turning in the direction of movement (balancing turn).

Figure 4:
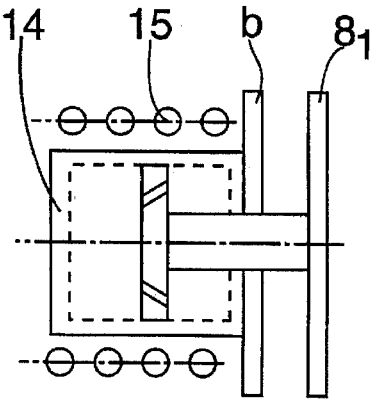
FIG. 4 is a diagrammatic view of the tilting actuator in FIG. 3.
Figure 3:
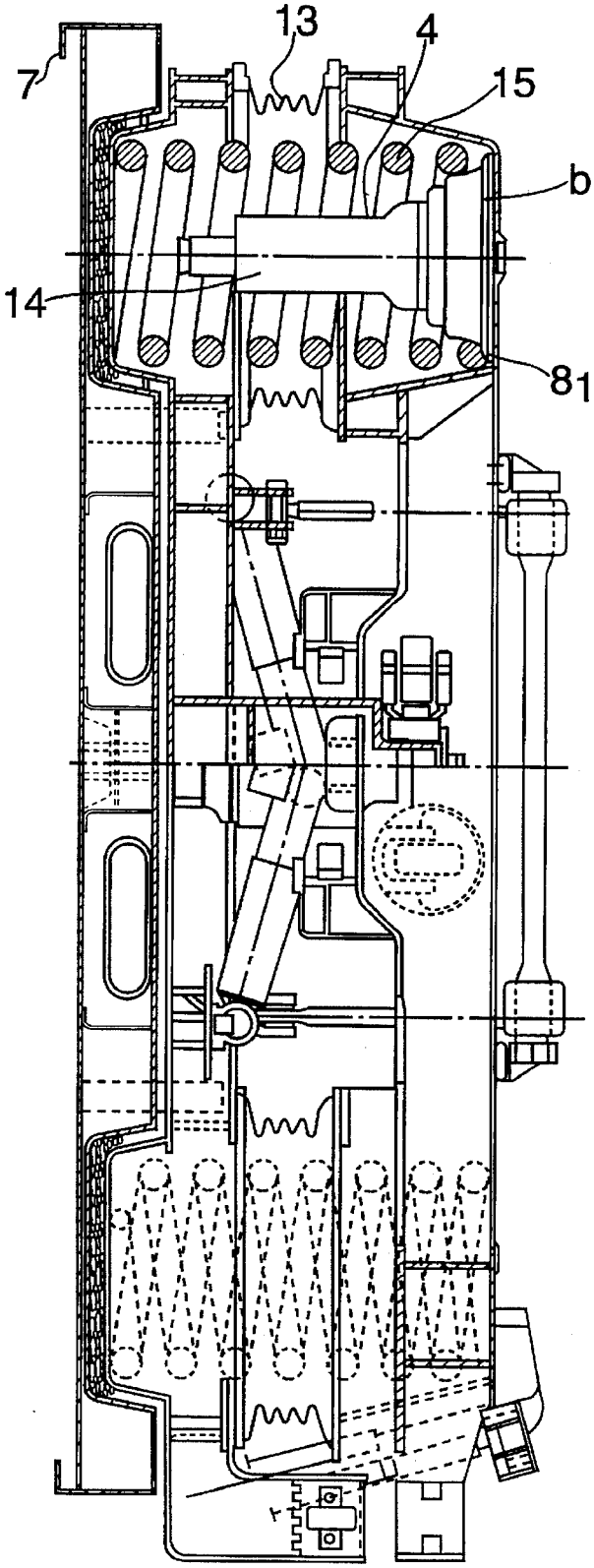
FIG. 3 is a sectional view in elevation of another practical implementation of the invention.

Configuration 2: Secondary Differentiated Suspension (FIGS. 3 and 4)

The other possible configuration for the tilting system consists of fixing in a conventional bogie two tilting actuators (4) between the bogie chassis ($8_1$) and the base (b) of the secondary vertical suspension (13). The task of these actuators (4) is that of creating a relative displacement of the base (b) of the secondary vertical suspension in relation to the bogie chassis ($8_1$).

We describe hereafter an example of the application of this solution which consists of incorporating two hydraulic cylinders (14) of simple effect and of tipping types supported within the base of the helicoidal springs (15) of the secondary suspension of a conventional passenger bogie. The body of the cylinder is contained within the interior space of the spring.

The problem created by this solution is that the cylinder (14) has to bear the weight of the frame (7) which is above it.

FIG. 3 shows a transverse section of a conventional bogie having spring type vertical suspension in which one can see the assembly of the tilting cylinder based upon this configuration.

It will be understood that in place of the profile of lateral and angular acceleration, one can programme the profile of the speed or displacement (only if it is to be derived) of the vehicle/passenger, or with uncompensated acceleration which is the uncompensated lateral acceleration through gravity, or other related variable.

We claim:

1. Tilting system mounted completely on a railway vehicle comprising:

a) a memory unit containing memorized parameters of a plurality of routes, the memorized parameters of each of said routes divided into sections, each of said sections being identified at least by radius of curvature, length of curve, difference in curves of inner and outer rails and memorized absolute position;

b) a position detector system which continually sends actual parameters of speed and actual absolute position of the vehicle to c) an intelligent control unit establishing a set of instructions on the basis of the values of said memorized parameters and actual parameters; and d) tilting actuator units placed between a bogie chassis and a vehicle frame, and connected to said control unit to receive said instructions so as to effect the orientation of said vehicle frame at track curves.

2. Tilting system for railway vehicle of claim 1 wherein said system has relative movement measuring units between the vehicle frame and the bogie chassis, from which signals are sent to the control unit.

3. Tilting system for railway vehicle of claim 1 further comprising a system for axle orientation reducing imbalance of lateral wheel-carriage stresses in two axles of the bogie chassis.

4. Tilting system for railway vehicle of claim 1 further comprising a tilting cross-beam positioned between the vehicle frame and the bogie chassis.

5. Tilting system for railway vehicle of claim 1 wherein said vehicle has a secondary vertical suspension and said tilting actuator units are placed between the bogie chassis and a base of said secondary vertical suspension.

6. Tilting system for railway vehicle of claim 5 wherein said secondary vertical suspension are suspension springs and each said tilting actuator unit is a fluidic cylinder supported within said springs.

7. Tilting system for railway vehicle of claim 1 wherein said set of instructions is obtained by an application of a program of dynamic simulation of behavior of the vehicle in a curve.

8. Tilting system for railway vehicle of claim 1 further comprising a secondary suspension comprising helicoidal springs and wherein the tilting actuator units are located within said springs.

* * * * *